United States Patent [19]

Bando

[11] Patent Number: 4,727,016

[45] Date of Patent: Feb. 23, 1988

[54] SILVER HALIDE PHOTOGRAPHIC LIGHT SENSITIVE MATERIAL HAVING DIFFERENT SIZED SILVER HALIDE EMULSIONS IN THE SAME LAYER

[75] Inventor: Shinsuke Bando, Kanagawa, Japan

[73] Assignee: Fuji Photo Film Co., Ltd., Kanagawa, Japan

[21] Appl. No.: 798,059

[22] Filed: Nov. 14, 1985

[30] Foreign Application Priority Data

Nov. 14, 1984 [JP] Japan ..... 59-240288

[51] Int. Cl.[4] ..... G03C 1/08; G03C 1/02

[52] U.S. Cl. ..... 430/567; 430/502; 430/506; 430/509

[58] Field of Search ..... 430/567, 502, 506, 509

[56] References Cited

U.S. PATENT DOCUMENTS 4,301,241 11/1981 Saito ..... 430/569

4,481,288 11/1984 Yamada et al. ..... 430/567

FOREIGN PATENT DOCUMENTS 1469480 4/1977 United Kingdom .

*Primary Examiner*—Paul R. Michl

*Assistant Examiner*—Mukund J. Shah

*Attorney, Agent, or Firm*—Sughrue, Mion, Zinn, Macpeak & Seas

[57] ABSTRACT

A photographic light-sensitive material comprising a support having provided thereon at least one silver halide emulsion layer is disclosed, which contains in said silver halide emulsion layer two silver halide emulsions which are different from each other in mean grain size and which satisfy the conditions that:

one of the silver halide emulsions, having a relatively larger mean grain size, has a mean grain size ($X_1$) of 1.3 μm or more;

the mean grain size ($X_2$) of the other silver halide emulsion, having a relatively smaller mean grain size, and $X_1$ has a relation satisfying Formula (1)

Formula (1): $0.5 \leqq X_2/X_1 \leqq 0.9$;

the ratio of the standard deviation ($S_1$) of the grain sizes of the silver halide emulsion having a relatively larger mean grain size to $X_1$ satisfies the Formula (2)

Formula (2): $S_1/X_1 \leqq 0.25$;

the ratio of the standard deviation ($S_2$) of the grain sizes of the silver halide emulsion having a relatively smaller mean grain size to $X_2$ satisfies Formula (3)

Formula (3): $0.2 < S_2/X_2$; and the two ratios of standard deviation of grain sizes of silver halide emulsion to mean grain size satisfy Formula (4)

Formula (4): $S_1/X_1 < S_2/X_2$.

10 Claims, No Drawings

SILVER HALIDE PHOTOGRAPHIC LIGHT SENSITIVE MATERIAL HAVING DIFFERENT SIZED SILVER HALIDE EMULSIONS IN THE SAME LAYER

FIELD OF THE INVENTION

This invention relates to a silver halide photographic light-sensitive material having a wide exposure latitude, showing excellent graininess and sharpness properties, and having a low silver content.

BACKGROUND OF THE INVENTION

In the field of silver halide color photographic light-sensitive materials, it has conventionally been desired to raise sensitivity and image quality of the light-sensitive materials. This tendency has been particularly remarkable in recent years. In general, however, higher sensitivity requires to use of silver halide grains having larger grain size, and hence attempts to raise sensitivity have inevitably encountered the problems of deterioration of graininess and reduction of gamma. Therefore, techniques for imparting good graininess and high gamma while maintaining high sensitivity have been strongly desired.

One technique for obtaining high gamma while keeping high sensitivity is to narrow the grain size distribution of emulsion grains. For example, mono-dispersed emulsions as disclosed in British Patent No. 1,469,480 or Japanese Patent Application (OPI) No. 142,329/80 (corresponding to U.S. Pat. No. 4,301,241) can provide a high gamma. (The term "OPI" as used herein refers to a published unexamined Japanese Patent Application.) In addition, another effective technique for obtaining a high gamma is to make development initiation of every grain uniform by minimizing the difference in halide composition between grains. Thus, an approach of making an emulsion mono-dispersed and narrowing iodide distribution between grains has been made, for example, as described in Japanese Patent Application (OPI) No. 153,428/77 (corresponding to U.S. Pat. No. 4,150,994).

Further, in order to obtain good graininess while keeping high sensitivity, it is necessary to increase the number of grains to be developed. In general, mono-dispersed emulsions contain more developable grains than poly-dispersed emulsions at a certain exposure amount or less than that, thus providing better graininess.

However, it is known that, since mono-dispersed emulsions generally have such a narrow size distribution that they have a narrow exposure latitude and, in a high exposure region, they do not necessarily give better graininess than poly-dispersed emulsions having the same mean grain size. In order to overcome this defect, an approach has been employed of incorporating several kinds of mono-dispersed emulsions different from each other in mean grain size in different layers to form a multi-layer coating or, as is disclosed in Japanese Patent Application (OPI) No. 178,235/82 and 72,440/84 (corresponding to U.S. Pat. Nos. 4,446,228 and 4,481,288, respectively) to use these emulsions as a mixture in the same silver halide emulsion layer.

However, the present inventor has found that in order to obtain the same exposure latitude, higher gamma, and excellent graininess while keeping sensitivity by using only mono-dispersed emulsions as described above, in comparison with poly-dispersed emulsions having as large a mean grain size as 1.3 μm or more (this size is generally desired in high sensitivity color photographic materials), three or more mono-dispersed emulsions different from each other in mean grain size must be prepared and separately multi-coated, or must be mixed in an appropriate ratio to use in one and the same emulsion layer. This technique is far from practical use due to its complexity.

As is mentioned above, the conventional techniques of using mono-dispersed silver halide to improve graininess and gamma of high speed silver halide color photographic light-sensitive materials are not totally satisfactory, since it is effective only in limited exposure region, or are too complicated to practice.

SUMMARY OF THE INVENTION

An object of the present invention is to provide a color photographic light-sensitive material having high sensitivity, wide exposure latitude, excellent graininess, and high gamma by a comparatively simple technique.

As a result of intensive investigations, the inventor has discovered that good graininess and constantly high gamma can be attained over the range of from low exposure regions to high exposure regions, while keeping high sensitivity and wide exposure latitude, by having in the same silver halide emulsion layer a large-sized, mono-dispersed silver halide emulsion and another silver halide emulsion which has a smaller mean grain size and a wider grain size distribution than that of the mono-dispersed silver halide emulsion.

The fact that using two kinds of silver halide emulsions as a mixture, to make the grain size distribution of an emulsion having a larger mean grain size narrower than that of an emulsion having a smaller mean grain size, is preferable for maintaining gamma constant seems reasonable also in view of the report by G. C. Farnell, *The Journal of Photographic Science,* Vol. 24, 1976 or the report by J. W. Mitchell, *The Journal of Photographic Science,* Vol. 31, 1983 that larger grains have wider sensitivity distribution between grains.

The above-described and other objects of the present invention are attained by using, in the same silver halide emulsion layer of a silver halide photographic light-sensitive material, a large-sized mono-dispersed silver halide emulsion and a semi-mono-dispersed or poly-dispersed silver halide emulsion having a smaller mean grain size and a wider grain size distribution than that of the former emulsion in an appropriate mixing ratio.

More specifically, the objects of the present invention are attained by a silver halide photographic light-sensitive material comprising a support having provided thereon at least one silver halide emulsion layer, which contains in said silver halide emulsion layer two silver halide emulsions which are different from each other in mean grain size and which satisfy the conditions that one of the silver halide emulsions, having relatively larger mean grain size, has a mean grain size ($X_1$) of 1.3 μm or more;

the mean grain size ($X_2$) of the other silver halide emulsion, having a relatively smaller mean grain size, and $X_1$ have a relation satisfying Formula (1)

Formula (1): $0.5 \leqq X_2/X_1 \leqq 0.9$;

the ratio of the standard deviation ($S_1$) of the grain sizes of the silver halide emulsion having relatively larger mean grain size to $X_1$ satisfies Formula (2)

Formula (2): $S_1/X_1 \leqq 0.25$;

the ratio of standard deviation ($S_2$) of the grain sizes of the silver halide emulsion having relatively smaller mean grain size to $X_2$ satisfies Formula (3)

Formula (3): $0.2 < S_2/X_2$;

and the two ratios of standard deviation of grain sizes of silver halide emulsion to mean grain size satisfy Formula (4)

Formula (4): $S_1/X_1 < S_2/X2$.

DETAILED DESCRIPTION OF THE INVENTION

In the present invention, the breadth of the grain size distribution of silver halide emulsion is presented by using the ratio of mean grain size (X) of the silver halide grains to standard deviation (S) of the grains (S/X).

Silver halide emulsions having an extremely narrow grain size distribution of $S/X \leqq 0.20$ are referred to as mono-dispersed silver halide emulsions, and silver halide emulsions having a somewhat broad grain size distribution of $0.20 < S/X \leqq 0.25$ are referred to as semi-mono-dispersed silver halide emulsions.

On the other hand, emulsions having a grain size distribution outside the range, i.e., $0.25 < S/X$, are called poly-dispersed silver halide emulsions.

The silver halide color photographic light-sensitive materials in accordance with the present invention are superior to color photographic light-sensitive materials comprising silver halide emulsion layers containing only poly-dispersed silver halide emulsions in gamma ($\gamma$) graininess, and silver-saving and silver removing properties.

The color photographic light-sensitive materials in accordance with the present invention are superior to color photographic light-sensitive materials using only a mono-dispersed and semi-mono dispersed silver halide emulsion in width of exposure latitude and graininess in high exposure region.

Further, the color photographic light-sensitive materials in accordance with the present invention are superior to those which have silver halide emulsion layers containing two mono-dispersed silver halide emulsions different from each other in mean grain size or those wherein the two mono-dispersed emulsions are coated as different layers, in the simplicity of the practically necessary steps. Thus, about the same high quality can be obtained more simply.

The silver halide photographic light-sensitive material in accordance with the present invention is preferably a silver halide color photographic light-sensitive material which comprises a support having provided thereon a plurality of silver halide emulsion layers different from each other in color sensitivity, such as a blue-sensitive layer, a green-sensitive layer, a red-sensitive layer, etc.

The silver halide color photographic light-sensitive material usually contains a plutality of silver halide emulsions having the same color sensitivity but different light-sensitivity.

The silver halide emulsion layers satisfying the relation of the Formulae (1) to (4) may have any color sensitivity and any light sensitivity.

It is preferable to use emulsion layers according to the present invention simultaneously in a plurality of layers, since the result is more effective.

The mean grain size ($X_1$) of the silver halide emulsion to be used in the present invention having a relatively larger mean grain size is 1.3 $\mu$m or more, desirably 1.3 $\mu$m to 4.0 $\mu$m, more desirably 1.3 $\mu$m to 2.8 $\mu$m, in terms of mean diameter of isovolumic sphere.

The mean diameter of an isovolumic sphere can be calculated by determining the mean volume of the grains according to the Coulter counter method (see James, *The Theory of the Photographic Process*, 4th. ed., 1977, p. 101) and calculating the diameter of the isovolumic sphere.

The relation between standard deviation ($S_1$) of the grain sizes of the emulsion having a mean grain size of $X_1$ and the mean grain size is represented by Formula (2), i.e., $$S_1/X_1 \leqq 0.25.$$

That is, such silver halide emulsion is a mono-dispersed or semi-mono-dispersed silver halide emulsion referred to in the present invention.

Further, the mono-dispersed or semi-mono-dispersed silver halide emulsion desirably has a grain size distribution satisfying the relation $$0.15 \leqq S_1/X_1 \leqq 0.25,$$

more desirably $$0.15 \leqq S_1/X_1 \leqq 0.24.$$

Mean grain size ($X_2$) of the silver halide emulsion to be used in the present invention and having a relatively smaller mean grain size and mean grain size ($X_1$) of the aforementioned silver halide emulsion having a relatively larger mean grain size have the relation set forth in Formula (1).

$$0.5 \leqq X_2/X_1 \leqq 0.9,$$

and desirably $$0.6 \leqq X_2/X_1 \leqq 0.8.$$

Grain size distribution of this silver halide emulsion and standard deviation ($S_2$) of the grain size have the relation set forth in Formula (3)

$$0.2 < S_2/X_2.$$

That is, this silver halide emulsion is a semi-mono-dispersed silver halide emulsion or a poly-dispersed silver halide emulsion mentioned in the present invention. More preferably, the grain size distribution of the silver halide emulsion satisfies the relation of $$0.20 < S_2/X_2 \leqq 0.4,$$

most preferably $$0.20 < S_2/X_2 \leqq 0.30.$$

In addition, grain size distribution of the latter silver halide emulsion having a relatively smaller mean grain size must be wider than that of the former silver halide emulsion having a relatively larger mean grain size.

That is, they must satisfy the relation of Formula (4)

$$S_1/X_1 < S_2/X_2,$$

preferably, they further satisfy the relation of $$S_2/X_2 - S_1/X_1 \geqq 0.05.$$

The weight ratio of the silver halide emulsion having relatively larger mean grain size to the silver halide emulsion having a relatively smaller mean gran size to be used in the present invention may be optionally selected as the case demands, but usually ranges from 1/9 to 9/1.

The photographic silver halide emulsion which is used in the present invention can be obtained according to methods described, for example, in *P. Glafkides, Chimie et Physique Photographique* (Paul Montel 1967); G. F. Duffin, *Photographic Emulsion Chemistry,* Focal Press, 1966) and V. L. Zelikman et al, *Making and Coating Photographic Emulsion* (Focal Press, 1964).

For example, the process described in Japanese Patent Application (OPI) No. 142,329/80 can preferably be employed.

That is, mono-dispersed or semi-mono-dispersed silver halide emulsion can be obtained by using a silver halide seed crystal emulsion having any grain size distribution and adding thereto silver ion and halide ion in such rate that crystal growth speed in the crystal growth period becomes 30 to 100% of the critical crystal growth speed of crystals.

Mono-dispersed silver halide emulsions can be obtained by using a poly-dispsersed silver halide seed crystal emulsion and adding thereto the ions in such rate that the crystal growth speed becomes less than 30% of the critical crystal growth speed.

Further factors controlling the grain size and grain size distribution of silver halide emulsion include, in addition to the manner of adding silver ion and halide ion, pBr value (or pAg value) in the reactor, temperature, stirring speed, concentration of gelatin, silver halide solvent, grain size, number, and distribution of seed crystals allowed to previously exist in the reactor, and the like. Those skilled in the art can properly combine these factors to obtain desired grain size and grain size distribution. As the process for preparing mono-dispersed emulsions, various processes are known, and typical examples thereof are shown below: Japanese Patent Publication Nos. 153,428/77 and 42,739/80, U.S. Pat. Nos. 4,431,729, 4,259,438, British Patent No. 1,536,016, Japanese Patent Application (OPI) Nos. 39,027/76, 88,017/76, 158,220/79, 36,892/80, 196,541/83, 48,521/79, 99,419/79, 78,831/81, 178,235/82, 49,938/83, 37,635/83, 106,532/83, and 149,037/83.

Silver halide grains of the present invention may be in a regular crystal form such as cubic or octahedral form, in an irregular crystal form such as spherical or tabular form, or in a mixed form thereof, or may comprise a mixture of grains in different forms.

As the silver halide, any of silver bromide, silver bromoiodide, silver chlorobromide, silver chlorobromoiodide, and silver chloride may be used, with silver bromoiodide being particularly preferable. It is more preferable that silver bromoiodide contains from about 2 to 30 mol% of silver iodide to obtain a high speed light sensitive material. When the silver bromoiodide contains more than 30 mol% of silver iodide the image obtained therefrom tends to be of soft gradation which is not suitable for color photographic material.

In the case of using silver bromoiodide grains, they desirably possess a so-called shell-core structure wherein the core comprises a phase containing a higher content of silver iodide, and the shell comprises a phase containing a lower content of silver iodide.

Silver bromoiodide grains with the shell-core structure are excellent in graininess and gamma, and the use thereof raises the effects of the present invention.

Further, emulsions wherein tabular silver halide grains having a diameter-to-thickness ratio of 5/1 or more account for 50% or more of the total grains in terms of projected area may also be used.

The silver halide grains may have an inner portion and a surface layer different from each other in phase composition. In addition, silver halide grains of the type forming latent image mainly on the surface thereof and grains of the type forming latent image mainly within them may be used.

The photographic emulsion to be used in the present invention can be prepared by the processes described in P. Glafkides, *Chimie et Physique Photographique* (Paul Montel, 1967), G. F. Duffin, *Photographic Emulsion Chemistry* (The Focal Press, 1966); V. L. Zelikman et al, *Making and Coating Photographic Emulsion* (The Focal Press, 1964), etc., in addition to the foregoing patents. That is, any of an acidic process, a neutral process, and an ammonical process can be used. As a manner of reacting a soluble silver salt with a soluble halide salt, any of one side-mixing, simultaneous mixing, and their combination may be employed.

A process of forming grains in the presence of excess silver ion (called reverse mixing process) can be employed as well. As one type of simultaneous mixing, a process called controlled double jet process wherein pAg in a liquid phase in which silver halide is formed is kept constant can be employed. This process provides a silver halide emulsion containing silver halide grains of regular crystal form having an approximately uniform particle size.

During formation or physical ripening of silver halide grains, cadmium salts, zinc salts, lead salts, thallium salts, iridium salts or complex salts thereof, rhodium salts or complex salts thereof, iron salts or complex salts thereof, etc., which has function of, for example, sensitizing, stabilizing or retarding of reciprocity failure, may be allowed to coexist.

Upon formation of silver halide grains, it is desirable to use, as silver halide solvent, ammonia, potassium, rhodanide, thioether compounds (e.g., those described in U.S. Pat. Nos. 3,271,157, 3,574,628, 3,704,130, 4,297,439, 4,276,374, etc.), thione compounds (e.g., those described in Japanese Patent Application (OPI) Nos. 144,319/78, 82,408/78, 77,737/80, etc.), amine compounds (e.g., those described in Japanese Patent Application (OPI) No. 100,717/79, etc.) or the like for controlling the growth of grains and render them mono-dispersed. Of these, ammonia and the thioether compounds are particularly preferable.

After the formation of the grains or after physical ripening, the soluble salts are usually removed from the emulsion. For this purpose, the well-known noodle washing method in which gelatin is subjected to gelation may be used. Furthermore, a flocculation method which employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin) may be used.

Silver halide emulisons are usually chemically sensitized. Chemical sensitization can be conducted according to the processes described, for example, in H. Frieser, *Die Grundlagen der Photographischen Prozesse mit Silber-halogeniden* (Akademische Verlagsgesellschaft, 1968), pp. 675–734.

That is, sulfur sensitization using sulfur-containing compounds capable of reacting with active gelatin or silver (e.g., thiosulfates, thioureas, mercapto compounds, rhodanines, etc.), reduction sensitization using a reductive substance (e.g., stannous salts, amines, hydrazine derivatives, formamidine-sulfinic acids, silane compounds etc.), and noble metal sensitization using a compound of noble metal (e.g., complex salts of the group VIII metals such as Pt, Ir, Pd, etc., as well as gold complex salts) can be employed independently or in combination.

To the photographic emulsion to be used in the present invention may be incorporated various compounds for the purpose of preventing formation of fog or for stabilizing photograhic properties in the steps of producing, or during storage or processing of light-sensitive materials. That is, azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothioadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindenes (e.g., triazaindenes, tetrazaindenes (particularly 4-hydroxy-substituted (1,3,3a,7)-tetrazaindenes), pentazaindenes, etc.); benzenethiosulfonic acid, benzenesulfinic acid, benzenesulfonic acid amide. etc., known as antifoggants or stabilizers can be added.

The light-sensitive material of this invention may contain various known surface active agents for various purposes, e.g., as a coating aid, for preventing the generation of static charges, improving slip characteristics, improving emulsion dispersion, preventing adhesion, improving photographic characteristics (e.g., accelerating development, increasing contrast, sensitization), etc.

For example, nonionic surface active agents such as saponin (steroids), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatibes (such as alkenylsuccinic acid polyglycerides or alkylphenol polyglycerides), aliphatic esters of polyvalent alcohols or alkyl esters of succharose; anionic surface active agents containing an acidic group such as a carboxy group, a sulfo group, a phospho group, a sulfonic acid ester group or a phosphoric acid ester group, such as alkylcarboxylates, alkylsulfonates, alkylbenzenesulfonates, alkylnaphthalenesulfonates, alkylsulfates, alkylphosphoric acid esters, N-acyl-N-alkyl-taurines, sulfosuccinates, sulfoalkylpolyoxyethylene alkylphenyl ethers or polyoxyethylene alkylphosphoric acid esters; amphoteric surface active agents such as amino acids, aminoalkylsulfonic acids, aminoalkylsulfuric acid esters, aminoalkylphosphoric acid esters, alkylbetaines or amine oxides; and cationic active agents such as alkylamine salts, aliphatic or aromatic quaternary ammonium salts, hetero ring quaternary ammonium salts (such as pyridinium or imidazolium salts) or phosphonium or sulfonium salts containing an alicyclic or heterocyclic ring can be used.

The light-sensitive material of the present invention may contain a polyalkylene oxide or its ether, ester or amine derivative, a thioether compound, a thiomorpholine, a quaternary ammonium salt compound, a urethane derivative, a urea derivative, an imidazole derivative, a 3-pyrazolidone, etc., for the purpose of enhancing sensitivity or contrast or for accelerating development.

Photographic light-sensitive materials to be used in the present invention may contain in the photographic emulsion layer or other hydrophilic colloidal layers a water-insoluble or slightly water-soluble synthetic polymer dispersion for the purpose of improving dimensional stability or the like. For example, polymers containing as monomer components alkyl(meth)acrylates, alkoxyalkyl(meth)acrylates, glycidyl(meth)acrylates, meth(acrylamides, vinyl esters (e.g., vinyl acetate), acrylonitrile, olefin, styrene, etc., alone or in combination, or polymers containing as monomer components combinations of the above-described monomers and acrylic acid, methacrylic acid, $\alpha,\beta$-unsaturated dicarboxylic acid, hydroxyalkyl(meth)acrylates, sulfoalkyl(meth)acrylates, styrenesulfonic acid, etc., may be used.

Photographic emulsions to be used in the present invention may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes.

The present invention may also be applied to a multilayered, multi-color photographic material comprising a support having provided thereon at least two layers different from each other in spectral sensitivity. Multilayered, natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. The red-sensitive emulsion layer usually contains a cyan-forming coupler, the green-sensitive emulsion layer a magenta-forming coupler, and the blue-sensitive emulsion layer a yellow-forming coupler. However, in some cases, different combinations may be employed.

The photographic light-sensitive material prepared according to the present invention may contain in the same or other photographic emulsion layers or light-insensitive layers color-forming couplers capable of forming color by oxidation coupling with an aromatic primary amine developing agent (for example, a phenylenediamine derivative or an aminophenol derivative) in color development processing. For example, magenta couplers include 5-pyrazolone couplers, pyrazolobenzimidazole couplers, pyrazoloimidazole couplers, pyrazolopyrazole coupers, pyrazolotriazole couplers, pyrazolotetrazole couplers, cyanoacetylcoumarone couplers, open-chain acylacetonitrile couplers, yellow couplers include acylacetamide couplers (e.g., benzoylacetanilides, pivaloylacetanilides, etc.), etc., and cyan couplers include naphthol couplers and phenol couplers. Of these couplers, non-diffusible couplers having a hydrophobic group called ballast group or polymerized couplers are desirable. The couplers may be of either 4-equivalent type or 2-equivalent type with respect silver ion. Colored couplers having a color-correcting effect or couplers capable of releasing a development inhibitor upon development (called DIR couplers) may also be used.

In addition to the DIR couplers, non-color forming DIR coupling compounds capable of forming a colorless coupling reaction product and releasing a development inhibitor may also be incorporated. Compounds capable of releasing a development inhibitor as a function of development may be incorporated in light-sensitive materials as well as the DIR couplers.

Two or more of the above-described couplers and the like may be used in the same layer or the same compound may be added to two or more different layers in order to obtain properties required for light-sensitive materials.

The photographic light-sensitive material prepared according to the present invention may contain an organic or inorganic hardener in its photographic emulsion layers or other hydrophilic colloidal layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

In the case of using a dye or a UV-ray absorbent in the hydrophilic colloidal layer of the light-sensitive material prepared according to the present invention, they may be mordanted with a cationic polymer or the like.

The light-sensitive material of the present invention may contain a hydroquinone derivative, an aminophenol derivative, a gallic acid derivative, an ascorbic acid derivative, etc., as a color fog-preventing agent.

The light-sensitive material prepared according to the present invention may contain in its hydrophilic layer a water-soluble dye as a filter dye or for various purposes such as prevention of irradiation. Such dye includes oxonol dyes, hemioxonol dyes, styryl dyes, merocyanine dyes, cyanine dyes, and azo dyes. Of these, oxonol dyes, hemioxonol dyes, and merocyanine dyes are particularly useful.

In practicing the present invention, the following known dye stabilizers (discoloration preventing agent) can be used. The color image-stabilizing agents to be used in the present invention may be used alone or in combinations of two or more. The known dye stabilizers include, for example, hydroquinone derivatives, gallic acid derivatives, p-alkoxyphenols, p-hydroxyphenol derivatives, bisphenols, and the like.

In photographic processing of the layers forming the photographic emulsion of the present invention, any of known processes and known processing solutions as described, for example, in *Research Disclosure* 176 (December, 1978), pp. 28–30 may be employed. Processing temperature is usually selected between 18° and 50° C. However, temperatures lower than 18° C. or higher than 50° C. may be employed.

The present invention is now illustrated in greater detail by reference to the following examples which, however, are not to be construed as limiting the present invention in any way.

EXAMPLE 1

Mono-dispersed, semi-mono-dispersed and poly-dispersed silver halide emulsions A to K were prepared using fine-grained silver halide seed crystals as follows changing grain sizes by controlling the ratio of the amount of seed crystals to that of added silver and changing the addition rate in the crystal-growing stage to thereby change grain size distribution.

Preparation of seed crystal emulsion:

1,200 ml of water, 6.5 g of KBr, 3.5 g of KI and 25 g of gelatin were added to a reaction vessel, and, while keeping the temperature of the mixture at 60° C., 1.5 ml of concentrated nitric acid was added thereto. Then, an aqueous solution containing 70 g of KBr and 4 g of KI was added thereto at a rate of 35 ml/min, and, starting after a 30-second delay, a 0.45 mol/liter solution of $AgNO_3$ was added at a rate of 65 ml/min, both for 20 minutes. After completion of the addition, the mixture was physically ripened for 20 minutes, followed by adding thereto a gelatin coagulant to cause flocculation. After washing with water, the flocculate was again dispersed to obtain 995 g of an emulsion. Silver halide grains contained in the resulting seed crystal emulsion had a mean grain size of 0.42 μm and a grain size distribution of 0.29.

Preparation of emulsions A to K:

3,000 ml of an aqueous solution containing 150 g of gelatin was charged in a reaction vessel, and the above-described seed emulsion was added thereto in an amount as shown in Table 1, and, while keeping the temperature at 75° C., a 25% $NH_3$ aqueous solution was added thereto also in an amount as shown in Table 1. Then, aqueous silver nitrate solutions I to IV described below were added in the first to fourth stage, respectively, in amounts and at rates shown in Table 1, simultaneously with an aqueous solution containing KBr and KI in a KI/KBr ratio as shown in Table 1.

In both cases, the addition was conducted with stirring. $NH_3$ was neutralized during the second and third stages. PAg in the reaction vessel was kept constant at a level shown in Table 1 in each stage.

Silver nitrate aqueous solution I:

An aqueous solution containing 0.5 mol/liter of $AgNO_3$

Silver nitrate aqueous solution II:

An aqueous solution containing 1.0 mol/liter of $AgNO_3$

Silver nitrate aqueous solution III:

An aqueous solution containing 1.5 mols/liter of $AgNO_3$

Silver nitrate aqueous solution IV:

An aqueous solution containing 2.0 mols/liter of $AgNO_3$

Each of the resulting emulsions was flocculated, washed with water, and again dispersed, followed by adding thereto sodium thiosulfate and chloroauric acid in suitable amounts to effect optimal chemical sensitization and, finally, a hydroxytetrazaindene compound in a proper amount.

AgI contents, mean grain sizes, and grain size distributions in terms of ratio of standard deviation of grain size to mean grain size of silver halide emulsions A to K are shown in Table 2.

The above-described silver halide emulsions A to K were coated independently or in combination to adjust the coated silver amount as shown in Table 3 to prepare multi-color light-sensitive materials 101 to 108 comprising a support having provided thereon the layers of the following formulation. Additionally, sample 101 is in accordance with the present invention, and samples 102 to 108 are comparative samples.

TABLE 1

| | | | First Stage | | | | Second Stage | | | |
|---|---|---|---|---|---|---|---|---|---|---|
| Emulsion | Amount of Seed Crystal Emulsion (g) | Amount of 25% $NH_3$ (ml) | Total Amount of Added Soln. I (ml) | Adding Rate (ml/min) | Molar Ratio of KI in Halide Aq. Soln. (%) | pAg | Total Amount of Added Soln. II (ml) | Adding Rate (ml/min) | Molar Ratio of KI in Halide Aq. Soln. (%) | pAg |
| A | 50 | 24 | 824 | 27.5 | 25 | 7.8 | 829 | 27.6 | 25 | 7.8 |
| B | 200 | 6 | 765 | 25.5 | 24 | 8.8 | 771 | 12.6 | 24 | 8.8 |
| C | 70 | 17 | 812 | 23.2 | 26 | 8.8 | 824 | 11.6 | 26 | 8.8 |
| D | 70 | 17 | 812 | 27.1 | 26 | 7.8 | 824 | 27.5 | 26 | 7.8 |
| E | 995 | 0 | 670 | 26.8 | 29 | 8.8 | 665 | 13.3 | 29 | 8.8 |
| F | 50 | 24 | 824 | 25.0 | 25 | 8.8 | 829 | 12.4 | 25 | 8.8 |
| G | 200 | 6 | 765 | 25.5 | 24 | 7.8 | 771 | 25.7 | 24 | 7.8 |
| H | 50 | 24 | 824 | 20.6 | 25 | 7.8 | 829 | 20.7 | 25 | 7.8 |
| I | 200 | 6 | 765 | 19.1 | 24 | 7.8 | 771 | 19.3 | 24 | 7.8 |
| J | 100 | 12 | 824 | 41.2 | 25 | 7.8 | 800 | 40.0 | 25 | 7.8 |
| K | 400 | 0 | 706 | 28.2 | 29 | 7.8 | 682 | 27.3 | 29 | 7.8 |

| | | | Third Stage | | | | Fourth Stage | | | |
|---|---|---|---|---|---|---|---|---|---|---|
| Emulsion | Amount of Seed Crystal Emulsion (g) | Amount of 25% $NH_3$ (ml) | Total Amount of Added Soln. II (ml) | Adding Rate (ml/min) | Molar Ratio of KI in Halide Aq. Soln. (%) | pAg | Total Amount of Added Soln. IV (ml) | Adding Rate (ml/min) | Molar Ratio of KI in Halide Aq. Soln. (%) | pAg |
| A | 50 | 24 | 525 | 17.5 | 0 | 8.8 | 559 | 18.6 | 0 | 8.8 |
| B | 200 | 6 | 525 | 12.5 | 0 | 9.8 | 559 | 13.0 | 0 | 9.8 |
| C | 70 | 17 | 525 | 8.5 | 0 | 9.8 | 559 | 7.9 | 0 | 9.8 |
| D | 70 | 17 | 525 | 26.3 | 0 | 8.8 | 559 | 26.3 | 0 | 8.8 |
| E | 995 | 0 | 392 | 26.1 | 0 | 9.8 | 500 | 19.6 | 0 | 9.8 |
| F | 50 | 24 | 525 | 7.6 | 0 | 9.8 | 559 | 6.6 | 0 | 9.8 |
| G | 200 | 6 | 525 | 32.8 | 0 | 8.8 | 559 | 34.9 | 0 | 8.8 |
| H | 50 | 24 | 525 | 13.1 | 0 | 8.8 | 559 | 14.0 | 0 | 8.8 |
| I | 200 | 6 | 525 | 26.3 | 0 | 8.8 | 559 | 28.0 | 0 | 8.8 |
| J | 100 | 12 | 525 | 26.3 | 0 | 8.8 | 559 | 28.0 | 0 | 8.8 |
| K | 400 | 0 | 525 | 43.8 | 0 | 8.8 | 559 | 46.6 | 0 | 8.8 |

TABLE 2

| Emulsion | Content of AgI (mol %) | Mean Grain Size (μm) | Grain Size Distribution | Class |
|---|---|---|---|---|
| A | 10.0 | 2.00 | 0.20 | mono-dispersed |
| B | 10.0 | 1.22 | 0.26 | poly-dispersed |
| C | 10.0 | 1.75 | 0.33 | poly-dispersed |
| D | 10.0 | 1.75 | 0.15 | mono-dispersed |
| E | 10.0 | 0.74 | 0.27 | poly-dispersed |
| F | 10.0 | 2.00 | 0.30 | poly-dispersed |
| G | 10.0 | 1.22 | 0.15 | mono-dispersed |
| H | 10.0 | 2.00 | 0.25 | semi-mono-dispersed |
| I | 10.0 | 1.22 | 0.21 | semi-mono-dispersed |
| J | 10.0 | 1.55 | 0.14 | mono-dispersed |
| K | 10.0 | 0.97 | 0.15 | mono-dispersed |

TABLE 3

| | 5th Layer | | 9th Layer | | 13th Layer | |
|---|---|---|---|---|---|---|
| Sample No. | Emulsion Used | Amount of Coated Ag ($g/m^2$) | Emulsion Used | Amount of Coated Ag ($g/m^2$) | Emulsion Used | Amount of Coated Ag ($g/m^2$) |
| 101 (present | A | 0.60 | A | 0.80 | A | 0.50 |
| invention) | B | 1.40 | B | 0.70 | B | 0.30 |
| 102 (comparative sample) | C | 2.00 | C | 1.50 | C | 0.80 |
| 103 (comparative sample) | D | 2.00 | D | 1.50 | D | 0.80 |
| 104 (comparative sample) | A | 0.60 | A | 0.80 | A | 0.50 |
| | E | 1.40 | E | 0.70 | E | 0.30 |
| 105 (comparative sample) | F | 0.60 | F | 0.80 | F | 0.50 |
| | B | 1.40 | B | 0.70 | B | 0.30 |
| 106 (comparative sample) | A | 0.60 | A | 0.80 | A | 0.50 |
| | G | 1.40 | G | 0.70 | G | 0.30 |
| 107 (comparative sample) | H | 0.60 | H | 0.80 | H | 0.50 |
| | I | 1.40 | I | 0.70 | I | 0.30 |
| 108 (comparative sample) | A | 0.60 | A | 0.80 | A | 0.45 |
| | J | 0.60 | J | 0.30 | J | 0.15 |

TABLE 3-continued

| Sample No. | 5th Layer Emulsion Used | 5th Layer Amount of Coated Ag ($g/m^2$) | 9th Layer Emulsion Used | 9th Layer Amount of Coated Ag ($g/m^2$) | 13th Layer Emulsion Used | 13th Layer Amount of Coated Ag ($g/m^2$) |
|---|---|---|---|---|---|---|
| | K | 0.80 | K | 0.40 | K | 0.20 |

1st Layer: Antihalation layer

A gelatin layer containing:
Black colloidal silver—0.18 $g/m^2$
UV ray absorbent C-1—0.16 $g/m^2$
UV ray absorbent C-2—0.77 $g/m^2$ 2nd Layer: Interlayer A gelatin layer containing:
Compound H-1 (color stain inhibitor)—0.18 $g/m^2$
Silver bromoiodide emulsion (AgI: 1 mol %; mean grain size 0.07 μm)—0.15 $g/m^2$ (as coated Ag, hereinafter the same)

3rd Layer: First red-sensitive emulsion layer

A gelatin layer containing:
AgBrI emulsion (AgI: 6 mol %; mean grain size: 0.5 μm)—0.72 $g/m^2$
Sensitizing dye I—$7.0\times10^{-5}$ mol/mol Ag
Sensitizing dye II—$2.0\times10^{-5}$ mol/mol Ag
Sensitizing dye III—$2.8\times10^{-4}$ mol/mol Ag
Sensitizing dye IV—$2.0\times10^{-5}$ mol/mol Ag
Coupler C-3—0.35 $g/m^2$
Coupler C-4—0.01 $g/m^2$
Coupler C-5—0.01 $g/m^2$ 4th Layer: Second red-sensitive emulsion layer A gelatin layer containing:
AgBrI emulsion (AgI: 6 mol %; mean grain size: 1.2 μm)—1.2 $g/m^2$
Sensitizing dye I—$5.2\times10^{-5}$ mol/mol Ag
Sensitizing dye II—$1.5\times10^{-5}$ mol/mol Ag
Sensitizing dye III—$2.1\times10^{-4}$ mol/mol Ag
Sensitizing dye IV—$1.5\times10^{-5}$ mol/mol Ag
Coupler C-3—0.20 $g/m^2$
Coupler C-4—0.01 $g/m^2$
Coupler C-5—0.01 $g/m^2$ 5th Layer: Third red-sensitive emulsion layer A gelatin layer containing:
AgBrI emulsion—(see Table 3)
Sensitizing dye I—$5.5\times10^{-5}$ mol/mol Ag
Sensitizing dye II—$1.6\times10^{-5}$ mol/mol Ag
Sensitizing dye III—$2.2\times10^{-5}$ mol/mol Ag
Sensitizing dye IV—$1.6\times10^{-5}$ mol/mol Ag
Coupler C-3—0.20 $g/m^2$ 6th Layer: Interlayer A gelatin layer containing:
Compound H-1—0.02 $g/m^2$ 7th Layer: First green-sensitive emulsion layer A gelatin layer containing:
AgBrI emulsion (AgI: 5 mol %; mean grain size: 0.4 μm)—0.55 $g/m^2$
Sensitizing dye V—$3.8\times10^{-4}$ mol/mol Ag
Sensitizing dye VI—$3.0\times10^{-5}$ mol/mol Ag
Coupler C-6—0.29 $g/m^2$
Coupler C-7—0.04 $g/m^2$
Coupler C-8—0.04 $g/m^2$
Coupler C-4—0.01 $g/m^2$ 8th Layer: Second green-sensitive layer A gelatin layer containing:
AgBrI emulsion (AgI: 6 mol %; mean grain size: 1.2 μm)—1.0 $g/m^2$
Sensitizing dye V—$2.7\times10^{-4}$ mol/mol Ag
Sensitizing dye VI—$2.01\times10^{-5}$ mol/mol Ag
Coupler C-9—0.04 $g/m^2$
Coupler C-7—0.001 $g/m^2$
Coupler C-8—0.001 $g/m^2$ 9th Layer: Third green-sensitive emulsion layer A gelatin layer containing:
AgBrI emulsion—(see Table 3)
Sensitizing dye V—$3.0\times10^{-4}$ mol/mol Ag
Sensitizind dye VI—$2.4\times10^{-5}$ mol/mol Ag
Coupler C-9—0.05 $g/m^2$
Coupler C-8—0.002 $g/m^2$ 10th Layer: Yellow filter layer A gelatin layer containing:
Yellow colloidal silver—0.04 $g/m^2$
Compound H-1—0.20 $g/m^2$ 11th Layer: First blue-sensitive emulsion layer A gelatin layer containing:
AgBrI emulsion (AgI: 5 mol %; mean grain size: 0.3 μm)—0.32 $g/m^2$
Coupler C-10—0.68 $g/m^2$
Coupler C-4—0.03 $g/m^2$ 12th Layer: Second blue-sensitive emulsion layer A gelatin layer containing:
AgBrI emulsion (AgI: 6 mol %; mean grain size: 0.8 μm)—0.29 $g/m^2$
Coupler C-10—0.20 $g/m^2$ 13th Layer: Third blue-sensitive emulsion layer A gelatin layer containing:
AgBrI emulsion—(see Table 3)
Coupler C-10—0.19 $g/m^2$ 14th Layer: First protective layer A gelatin layer containing:
UV ray absorbent C-1—0.20 $g/m^2$
UV ray absorbent C-2—0.90 $g/m^2$ 15th Layer: Second protective layer A gelatin layer containing:
Polymethyl methacrylate particles (diameter: 1.5 μm)—0.05 $g/m^2$ A gelatin hardener, C-11, and a surfactant were added to each layer in addition to the above-described formulation.

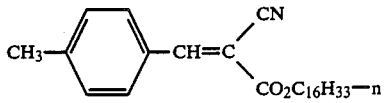
C-1
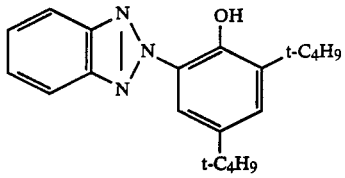
C-2
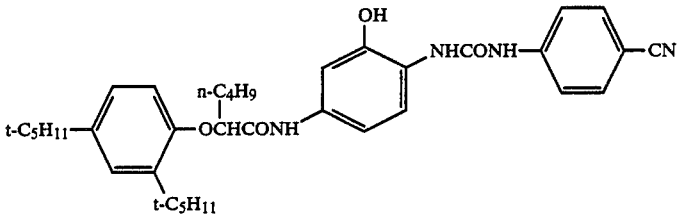
C-3
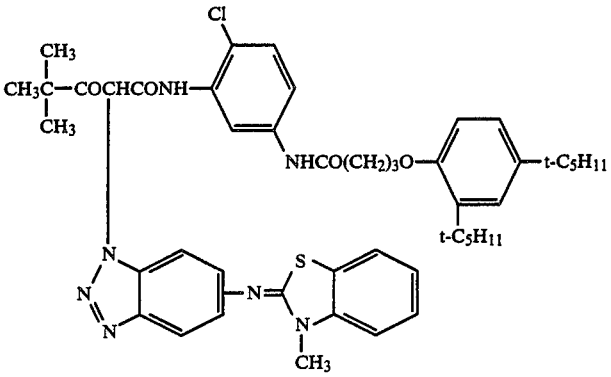
C-4
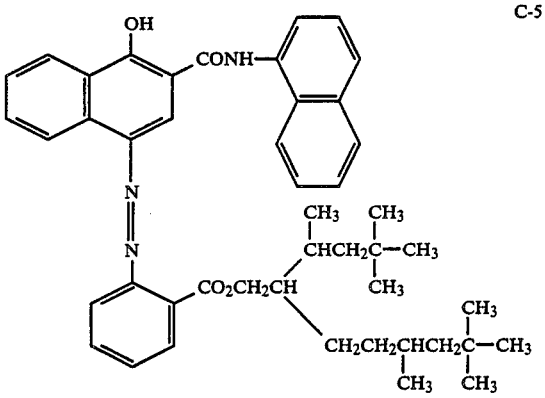
C-5
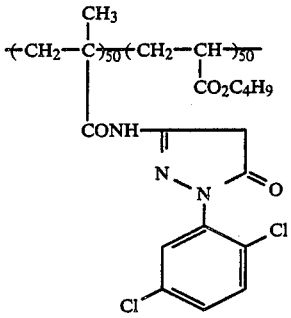
(subscripts following the divalent groups within parenthesis show weight % values of the polymeric unit.)
C-6
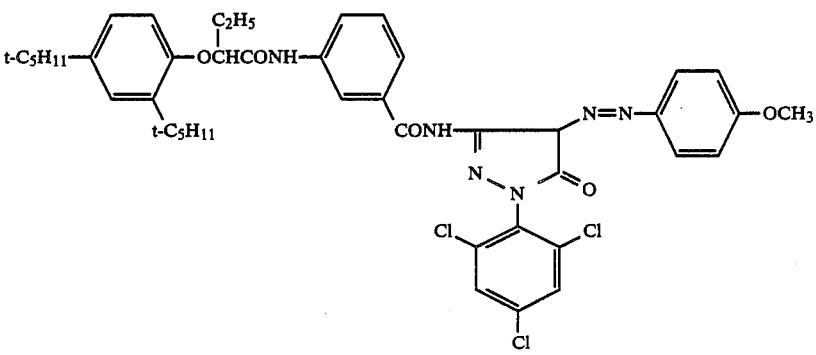
C-7

-continued
C-8
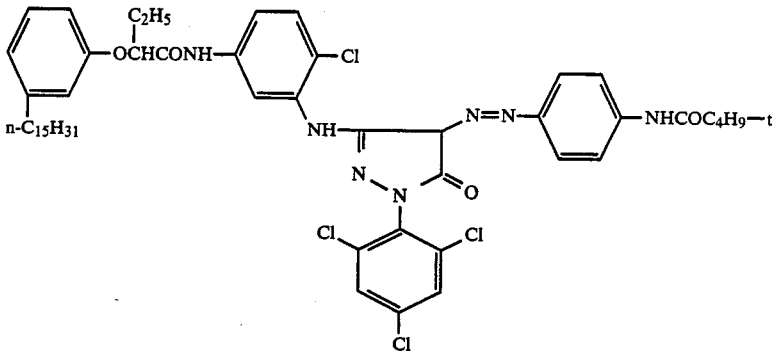
C-9
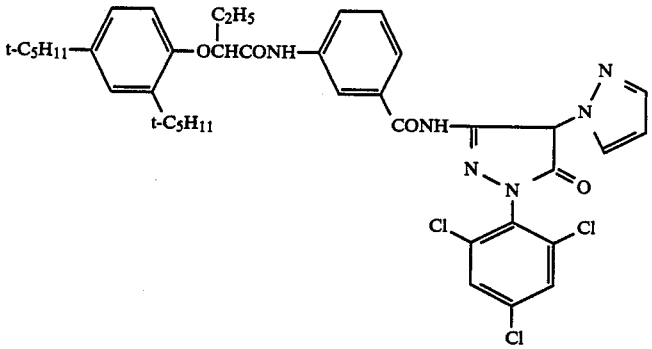
C-10
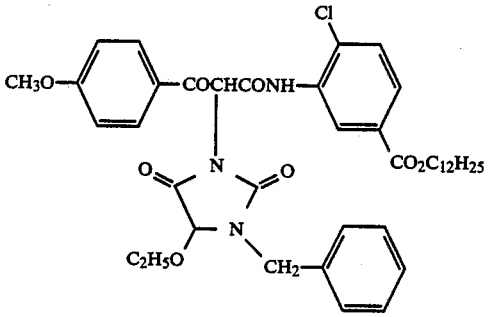
C-11 $(CH_2{=}CHSO_2CH_2CONHCH_2)_2$
H-1
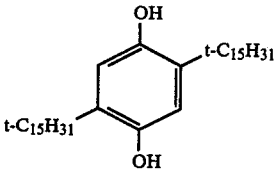
Sensitizing dye I
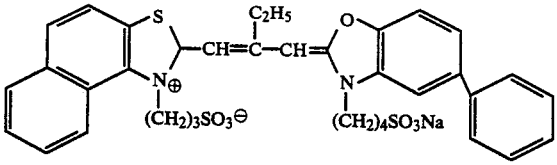
Sensitizing dye II
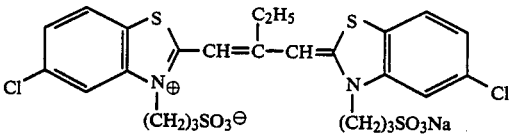
Sensitizing dye III
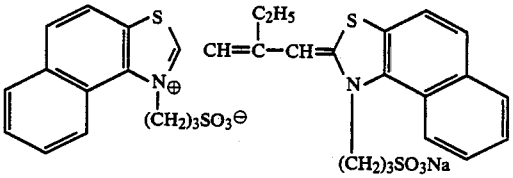
Sensitizing dye IV
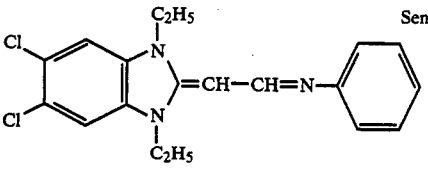
Sensitizing dye V
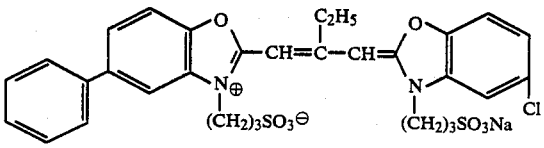
Sensitizing dye VI
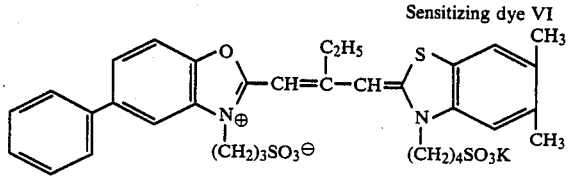

Each of these samples 101 to 108 was subjected to wedge exposure, then to the following color development processing 1.

| Steps of color development processing 1 (conducted at 38° C.) | |
|---|---|
| (1) Color development | 3 min. and 15 sec. |
| (2) Bleaching | 6 min. and 30 sec. |
| (3) Washing with water | 3 min. and 15 sec. |
| (4) Fixing | 6 min. and 30 sec. |
| (5) Washing with water | 3 min. and 15 sec. |
| (6) Stabilizing | 3 min. and 15 sec. |

Formulations of the processing solutions used in respective steps are as follows.

| | |
|---|---|
| (1) Color developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1 liter |
| (2) Bleaching solution: | |
| Ammonium bromide | 160.0 g |
| Aqueous ammonia (28%) | 25.0 cc |
| Sodium iron ethylenediaminetetraacetate | 130.0 g |
| Glacial acetic acid | 14.0 cc |
| Water to make | 1 liter |
| (4) Fixing solution: | |
| Sodium tetrapolyphosphate | 2.0 g |
| Sodium sulfite | 4.0 g |
| Ammonium thiosulfate (70%) | 175.0 cc |
| Sodium bisulfite | 4.6 g |
| Water to make | 1 liter |
| (6) Stabilizing solution: | |
| Formalin (37 wt % formaldehyde solution) | 8.0 cc |
| Water to make | 1 liter |

After the development, the densities of the cyan image, magenta image, and yellow image of these samples were measured to draw characteristic curves. Sensitivities, two gamma values, and the ratios of these two gamma values which show exposure latitude were determined. R.M.S. values of densities of respective images at two particular densities measured through an aperture of 48 μm in diameter were determined to compare graininess. The results thus obtained are tabulated in Table 4.

As is seen from Table 4, sample 101 in accordance withe the present invention showed a higher contrast and a better graininess than sample 102 using one polydispersed emulsion. In comparison with sample 103 using one mono-dispersed emulsion, sample 101 showed a wider exposure latitude and a better graininess in the portion having been exposed much. In the case of using a mixture of silver halide grains, samples 104 to 107, not satisfying the requirements of the present invention showed not so much effects of improving exposure latitude and graininess as sample 101 of the present invention. Finally, sample 108 using three mono-dispersed silver halide emulsions showed effects approximate to that of the present invention, but it is seen that this sample showed somewhat narrow exposure latitude and a poorer handiness than the sample of the present invention.

TABLE 4

| Sample | Relative Sensitivity | Gamma $\gamma_1$ | Gamma $\gamma_2$ | Latitude ($\gamma_2/\gamma_1$) | Graininess R.M.S. (1) | Graininess R.M.S. (2) |
|---|---|---|---|---|---|---|
| Cyan Image | | | | | | |
| 101 (present invention | 100 | 0.69 | 0.70 | 1.01 | 0.020 | 0.012 |
| 102 (comparative example | 100 | 0.57 | 0.56 | 0.98 | 0.025 | 0.016 |
| 103 (comparative example) | 95 | 0.73 | 0.50 | 0.68 | 0.018 | 0.017 |
| 104 (comparative example) | 97 | 0.63 | 0.71 | 1.13 | 0.023 | 0.011 |
| 105 (comparative example) | 100 | 0.55 | 0.69 | 1.25 | 0.024 | 0.013 |
| 106 (comparative example) | 100 | 0.64 | 0.60 | 0.94 | 0.021 | 0.013 |
| 107 (comparative example) | 100 | 0.63 | 0.69 | 1.10 | 0.021 | 0.014 |
| 108 (comparative example) | 100 | 0.68 | 0.67 | 0.99 | 0.020 | 0.012 |
| Magenta Image | | | | | | |
| 101 (present invention | 100 | 0.75 | 0.73 | 0.97 | 0.023 | 0.013 |
| 102 (comparative example) | 100 | 0.62 | 0.60 | 0.97 | 0.030 | 0.018 |
| 103 (comparative example) | 93 | 0.82 | 0.53 | 0.65 | 0.020 | 0.019 |
| 104 (comparative example) | 97 | 0.68 | 0.75 | 1.10 | 0.025 | 0.012 |
| 105 (comparative example) | 102 | 0.57 | 0.71 | 1.23 | 0.027 | 0.015 |
| 106 (comparative example) | 99 | 0.69 | 0.58 | 0.84 | 0.024 | 0.015 |
| 107 (comparative example) | 100 | 0.67 | 0.73 | 1.09 | 0.025 | 0.016 |
| 108 (comparative example) | 100 | 0.75 | 0.71 | 0.95 | 0.023 | 0.014 |
| Yellow Image | | | | | | |
| 101 (present invention) | 100 | 0.77 | 0.75 | 0.97 | 0.030 | 0.018 |
| 102 (comparative example) | 101 | 0.64 | 0.63 | 0.98 | 0.038 | 0.024 |
| 103 (comparative example) | 93 | 0.85 | 0.55 | 0.65 | 0.027 | 0.026 |
| 104 (comparative example) | 97 | 0.70 | 0.76 | 1.09 | 0.033 | 0.016 |
| 105 (comparative example) | 102 | 0.60 | 0.72 | 1.20 | 0.036 | 0.020 |
| 106 (comparative example) | 99 | 0.71 | 0.61 | 0.86 | 0.033 | 0.022 |
| 107 (comparative example) | 100 | 0.69 | 0.75 | 1.09 | 0.033 | 0.021 |
| 108 (comparative example) | 100 | 0.76 | 0.72 | 0.95 | 0.031 | 0.017 |

Notes Regarding Table 4

(Note 1) Relative sensitivies are presented as relative values taking the sensitivity of Sample 101 as 100, based on the reciprocals of exposure amounts imparting a density of the minimun density of each image + 0.15.

(Note 2) $\gamma_1$ represents the slope of a 11ne drawn between the point of the above-described exposure amount and the point at an exposure amount two times as much as said exposure amount on the characteristic curve.

(Note 3) $\gamma_2$ represents a slope of a line drawn between the point at an exposure amount two times as much as the exposure amount described in Note 1 on the characteristic curve and the point at an exposure amount four times as much as the exposure amount described in Note 1 on the characteristic curve.

(Note 4) Latitudes were presented as the ratio of $\gamma_2$ to $\gamma_1$ described above. The nearer the $\gamma_2/\gamma_1$ value is to 1, the more constant the change in density for the change in exposure amount, therefore the wider thelatitude.

(Note 5) R.M.S. (see Note 7) (1) represents the R.M.S. value of the density at an exposure amount two times as much as the exposure amount described in Note 1.

(Note 6) R.M.S. (2) represents R.M.S. value of the density at an exposure amount four times as much as the exposure amount described in Note 1.

(Note 7) Evaluation of granularity using the R.M.S. method is described in Photographic Science and Engineering, vol 19, No. 4, p235 (1975).

While the invention has been described in detail and with reference to specific embodiments therof, it will be apparent to one skilled in the art that various changes and modifications can be made therein without departing from the spirit and scope thereof.

What is claimed is:

1. A silver halide photographic light-sensitive material comprising a support having provided thereon at least one silver halide emulsion layer, which contains in said silver halide emulsion layer two silver halide emulsions which are different from each other in mean grain size and which satisfy the conditions that:

one of the silver halide emulsions, having a relatively larger mean grain size, has a mean grain size ($X_1$) of not less than 1.3 $\mu$m;

the mean grain size ($X_2$) of the other silver halide emulsion, having a relatively smaller mean grain size, and $X_1$ have a relation satisfying Formula (1)

Formula (1): $0.5 \leqq X_2/X_1 \leqq 0.9$;

the ratio of the standard deviation ($S_1$) of the grain sizes of the silver halide emulsion having a relatively larger mean grain size to $X_1$ satisfies Formula (2)

Formula (2): $S_1/X_1 \leqq 0.25$;

the ratio of the standard deviation ($S_2$) of the grain sizes of the silver halide emulsion having a relatively smaller mean grain size to $X_2$ satisfies Formula (3)

Formula (3): $0.2 < S_2/X_2$; and the two ratios of standard deviation of grain sizes of silver halide emulsion to mean grain size satisfy Formula (4)

Formula (4): $S_1/X_1 < S_2/X_2$.

2. A silver halide photographic light-sensitive material as in claim 1, wherein $X_1$ is from 1.3 $\mu$m to 4.0 $\mu$m.

3. A silver halide photographic light-sensitive material as in claim 1, wherein $X_2/X_1$ satisfies the formula $$0.6 \leqq X_2/X_1 \leqq 0.8.$$

4. A silver halide photographic light-sensitive material as in claim 1, wherein $S_1/X_1$ satisfies the formula $$0.15 \leqq S_1/X_1 \leqq 0.25.$$

5. A silver halide photographic light-sensitive material as in claim 1, wherein $S_2/X_2$ satisfies the formula $$0.20 < S_2/X_2 \leqq 0.40.$$

6. A silver halide photographic light-sensitive material as in claim 1, wherein $S_1/X_1$ and $S_2/X_2$ have a relation satisfying the formula $$S_2/X_2 - S_1/X_1 \geqq 0.05.$$

7. A silver halide photographic light-sensitive material as in claim 1, wherein the weight ratio of the silver halide emulsion having a mean grain size of $X_1$ to that having a mean grain size of $X_2$ is from 1/9 to 9/1.

8. A silver halide photographic light-sensitive material as in claim 1, wherein the silver halide is silver bromoiodide.

9. A silver halide photographic light-sensitive material as in claim 1, wherein the silver halide is silver bromoiodide containing from 2 to 30 mol% of silver iodide.

10. A silver halide photographic light-sensitive material as in claim 1, wherein the material is a color photographic material.

* * * * *